US011724289B2

(12) United States Patent
Haag et al.

(10) Patent No.: US 11,724,289 B2
(45) Date of Patent: Aug. 15, 2023

(54) WEB PROCESSING MACHINE COMPRISING AT LEAST ONE CLEANING DEVICE FOR CLEANING SUBSTRATE TRANSPORTED ALONG TRANSPORT PATH

(71) Applicant: KOENIG & BAUER AG, Würzburg (DE)

(72) Inventors: Thorsten Haag, Oberpleichfeld (DE); Elena Lang, Birkenfeld (DE)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 17/762,759

(22) PCT Filed: Oct. 8, 2020

(86) PCT No.: PCT/EP2020/078264
§ 371 (c)(1),
(2) Date: Mar. 23, 2022

(87) PCT Pub. No.: WO2021/104732
PCT Pub. Date: Jun. 3, 2021

(65) Prior Publication Data

US 2022/0362816 A1 Nov. 17, 2022

(30) Foreign Application Priority Data

Nov. 25, 2019 (DE) ..... 10 2019 131 799.1

(51) Int. Cl.
*B41F 23/00* (2006.01)
*B08B 5/04* (2006.01)
*B41J 29/17* (2006.01)

(52) U.S. Cl.
CPC ..... *B08B 5/046* (2013.01); *B41F 23/002* (2013.01); *B41J 29/17* (2013.01)

(58) Field of Classification Search
None
See application file for complete search history.

(56) References Cited

U.S. PATENT DOCUMENTS 6,364,959 B1 * 4/2002 Straub ..... B65G 45/22 162/278
2006/0086272 A1 4/2006 Bennet

FOREIGN PATENT DOCUMENTS

DE 19949753 A1 5/2000
DE 202005007401 U1 9/2005
(Continued)

OTHER PUBLICATIONS

English language translation of DE 20 2013 000 513 U1, publication date Apr. 22, 2014. (Year: 2014).*
(Continued)

*Primary Examiner* — Leslie J Evanisko
(74) *Attorney, Agent, or Firm* — Mattingly & Malur, PC

(57) ABSTRACT

In some examples, a processing machine has at least one cleaning device for cleaning a substrate. The at least one cleaning device and the at least one substrate are able to be arranged in a first and a second cleaning state, and the substrate is arranged at a distance from the at least one cleaning device in the first cleaning state. The substrate is arranged in contact with the at least one cleaning device in the second cleaning state, and the at least one cleaning device and the substrate are arranged so as to be transferable at least from the first cleaning state into the second cleaning state. The at least one cleaning device is arranged to be adjusted from a first cleaning position in the first cleaning state into a second cleaning position in the second cleaning state.

7 Claims, 8 Drawing Sheets

(56) References Cited

FOREIGN PATENT DOCUMENTS

| | | | | | |
|---|---|---|---|---|---|
| DE | 102011088776 | B3 | | 1/2013 | |
| DE | 202013000513 | U1 | * | 5/2014 | ..... B08B 1/002 |
| EP | 682992 | A2 | | 11/1995 | |
| EP | 909592 | A2 | | 4/1999 | |

OTHER PUBLICATIONS

International Search Report of PCT/EP2020/078264 dated Jan. 19, 2021.

* cited by examiner

WEB PROCESSING MACHINE COMPRISING AT LEAST ONE CLEANING DEVICE FOR CLEANING SUBSTRATE TRANSPORTED ALONG TRANSPORT PATH

CROSS-REFERENCES TO RELATED APPLICATIONS

This application is the US national phase, under 35 USC § 371, of PCT/EP2020/078264, filed Oct. 8, 2020; published as WO 2021/104732 A1 on Jun. 3, 2021, and claiming priority to DE 10 2019 131 799.1, filed Nov. 25, 2019, the disclosures of which are expressly incorporated by reference herein in their entireties.

TECHNICAL FIELD

Examples herein relate to a processing machine comprising at least one cleaning device for cleaning a substrate. It is possible to arrange the at least one cleaning device and the at least one substrate in a first cleaning state. The at least one cleaning device includes at least two flow elements and/or brushes, and, in the first cleaning state, the substrate is arranged spaced apart from the at least one cleaning device. Additionally, examples herein relate to a method for cleaning a substrate in a processing machine. A distance between at least one cleaning device and a substrate is adjusted as a function of the substrate properties and/or as a function of the substrate format and/or as a function of a mode of operation of the processing machine.

BACKGROUND

In processing machines, a substrate is processed in usually multiple processing steps. A distinction is made between web processing machines, in which a web-format substrate is processed, and sheet processing machines, in which a sheet-format substrate is processed. For example, materials having different dimensions are processed as material webs in web processing machines. For example, flexible materials, such as paperboard webs or paper webs, or rigid materials, such as wood or laminate web, are processed. Web processing machines are, for example, configured as die cutting, cutting, bending, folding, coating or printing machines. Various printing methods are used, for example, in printing presses. Non-impact printing (NIP) methods shall be understood to mean printing methods that do not require a fixed, i.e., physically invariable, printing forme. Such printing methods can generate different print images in each printing operation. Examples of non-impact printing methods include ionographic methods, magnetographic methods, thermographic methods, electrophotography, laser printing and, in particular, ink jet printing methods. Such printing methods usually have at least one image-producing device, for example at least one print head. In the case of the ink jet printing method, such a print head is configured, for example, as an ink jet print head and comprises at least one nozzle, and preferably multiple nozzles by means of which at least one printing fluid, for example in the form of ink droplets, can be transferred onto a printing substrate in a targeted manner. Alternative printing methods have fixed printing formes, for example gravure printing methods, planographic printing methods, offset printing methods, and letterpress printing methods, in particular flexographic printing methods. Depending on the print run volume and/or other requirements, such as the print quality, a non-impact printing method or a printing method using a fixed printing forme may be preferred. In web processing machines, material webs, for example paper webs, of various qualities are processed. For example, the paper reels contain dust and other foreign objects, such as sand or metal shavings. In a printing unit, in particular ink jet printing unit, these can result in a worsened print image and/or soiling of the printing mechanism or the print heads. Cleaning devices are therefore used to clean the paper web prior to processing, in particular printing, for example by using cleaning brushes and/or vacuum chambers.

Such a cleaning device comprising a vacuum chamber and a cleaning brush that is in contact with a substrate web is known from DE 20 2005 007 401 U1.

A device for cleaning a surface in a printing press is known from DE 199 49 753 A1. The device comprises multiple brushes and is in contact with a printing substrate for cleaning.

A rotary printing press is disclosed by DE 10 2011 088 776 B3. The rotary printing press comprises a printing substrate cleaning device including at least one brush and/or at least one vacuum system.

EP 0 682 992 A2 discloses a cleaning device comprising pressure air nozzles and suction openings. The cleaning device can be transferred from a cleaning position (running position) into a parked position/web threading position (web threading position). In this position, the cleaning device only provides support for the threading of the web. For this purpose, the cleaning device is shifted parallel to the web. This is not a second cleaning position with a second cleaning state.

A cleaning device for web cleaning using a vacuum chamber is disclosed by US 2006/0086272 A1. Various sections of the vacuum chamber can be controlled by way of pressure sensors.

A device and a method for the electrostatic surface discharge of a web in a printing press is known from DE 0 909 592 A2.

SUMMARY

It is the object of the invention to devise a processing machine comprising at least one cleaning device, and a method for cleaning.

The object is achieved by, in the second cleaning state, the substrate being arranged so as to be in contact with the at least two flow elements and/or the brushes of the at least one cleaning device. The at least one cleaning device and the substrate can be arranged so as to be transferrable at least from the first cleaning state into the second cleaning state, and the at least one cleaning device is arranged so as to be displaced from a first cleaning position in the first cleaning state into a second cleaning position in the second cleaning state. In the first cleaning position the at least one cleaning device is functionally connected to a cleaning region on the substrate and/or on the transport path intended for the substrate, and, in the second cleaning position of the at least one cleaning device, the cleaning region is arranged to be shifted on the substrate and/or on the transport path intended for the substrate. In the first cleaning state and in the second cleaning state, the at least one cleaning device is arranged to apply a suction force at least onto the cleaning region. The object is further achieved in the method, for setting the distance between the cleaning device and the substrate, by the cleaning device being displaced, parallel to the substrate and/or the transport path intended for the substrate, from a first cleaning state into a second cleaning state, and, in the cleaning states, the cleaning device applies a suction force onto the substrate.

An advantage to be achieved with the invention is, in particular, that a distance between a cleaning device and a substrate can be set. In particular, the distance and the cleaning position can be set as a function of the substrate properties and/or the substrate format and/or a machine speed. In particular, the distance between the cleaning device and the substrate can be set in such a way that it is possible to switch between contactless cleaning and cleaning with contact. In particular, the substrate surface is thus protected, and a scrap rate is reduced.

Another advantage to be achieved with the invention is, in particular, that a cleaning device for cleaning the substrate is arranged so as to be displaceable from a first cleaning position into a further cleaning position. In particular, a cleaning position of the cleaning device can thus be adapted as a function of the substrate.

Moreover, the number of different substrates to be processed can be increased by a displaceable arrangement of the cleaning device. In particular, the number of different cleaning devices can thus be decreased, and a high number of different materials can be processed using only one cleaning device. Moreover, the maintenance complexity is decreased, and operating costs of the processing machine are saved, as a result of the decreased number of cleaning devices.

Another advantage to be achieved with the invention is that, in the first cleaning position, the at least one cleaning device is arranged spaced apart from the substrate and, in the further cleaning position, it is arranged to be in contact with the substrate. For example, a displacement from the first cleaning position into the second cleaning position is carried out by shifting the cleaning device from a cleaning region having a high force component opposing the suction force into a cleaning region having a lower force component opposing the suction force. For example, a displacement from the first cleaning position into the second cleaning position is carried out by means of a shift parallel to the transport path of the substrate. Such a cleaning region having a high force component opposing the suction force is present, for example, when a guide element is arranged beneath the substrate. A cleaning region having a lower force component opposing the suction force is present, for example, when the substrate is arranged spaced apart from the guide element.

Another advantage to be achieved with the invention is the flexible arrangement of the cleaning device in the processing machine. In particular, the cleaning device can be arranged beneath and/or above the substrate. It is thus possible, in particular, to clean the upper side and/or underside of the substrate.

Another advantage to be achieved with the invention is an improved configuration of the cleaning device. In particular, accessibility for maintenance purposes and/or assemblability of the cleaning device are improved. For example, the improved accessibility and the improved assemblability are achieved by the displaceable arrangement of the cleaning device.

Another advantage to be achieved with the invention is the adaptation of the cleaning power and/or suction power to the substrate. In particular, a suction power and/or the operating zone of the cleaning device can be adapted to the substrate width.

Another advantage to be achieved with the cleaning device is that an automatic substrate web-up is ensured. In particular, the distance with respect to a guide element can be achieved by displacing the cleaning device from a first position into a further position, thereby facilitating a substrate web-up and/or paper web-up.

BRIEF DESCRIPTION OF THE DRAWINGS

Exemplary embodiments of the invention are illustrated in the drawings and will be described in greater detail below. The drawings show.

DETAILED DESCRIPTION

Figure 1:
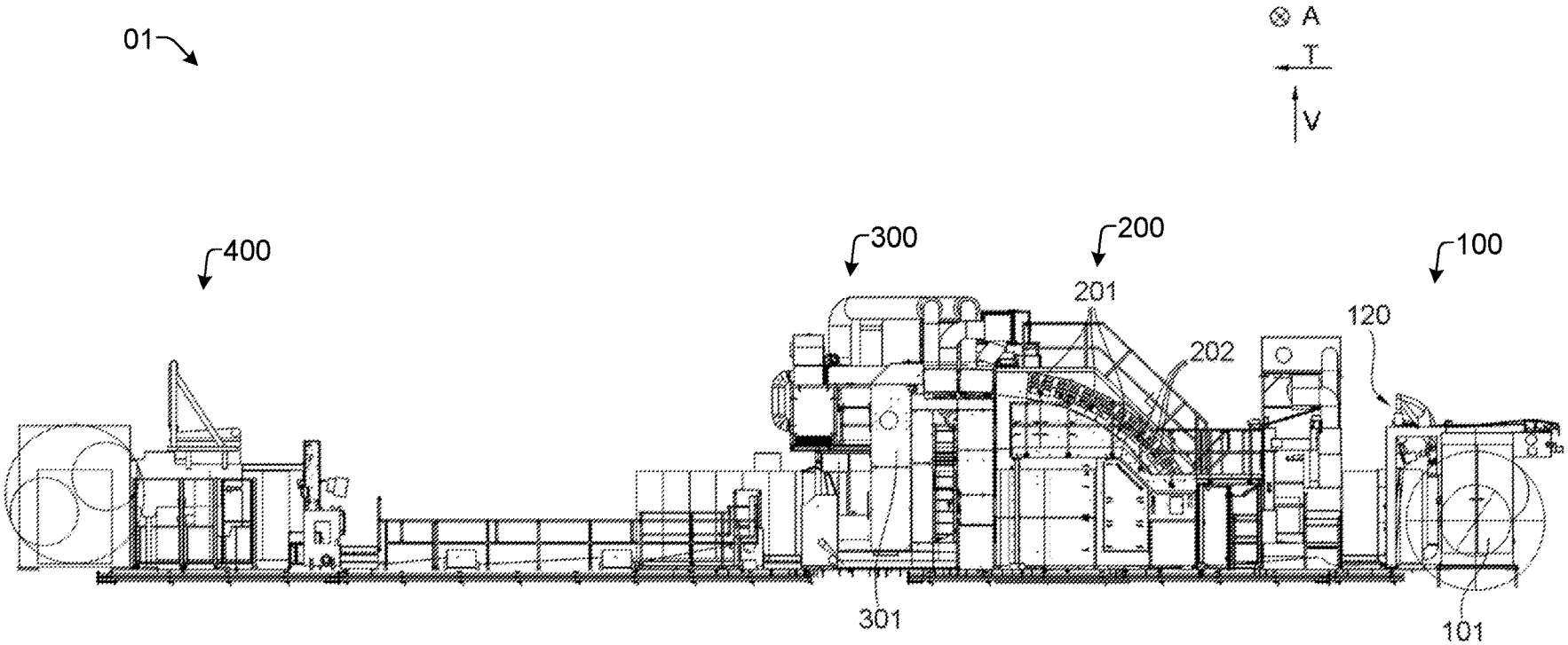
FIG. 1 a schematic illustration of a preferred embodiment of a processing machine as a web-fed ink jet printing press.
Figure 2:
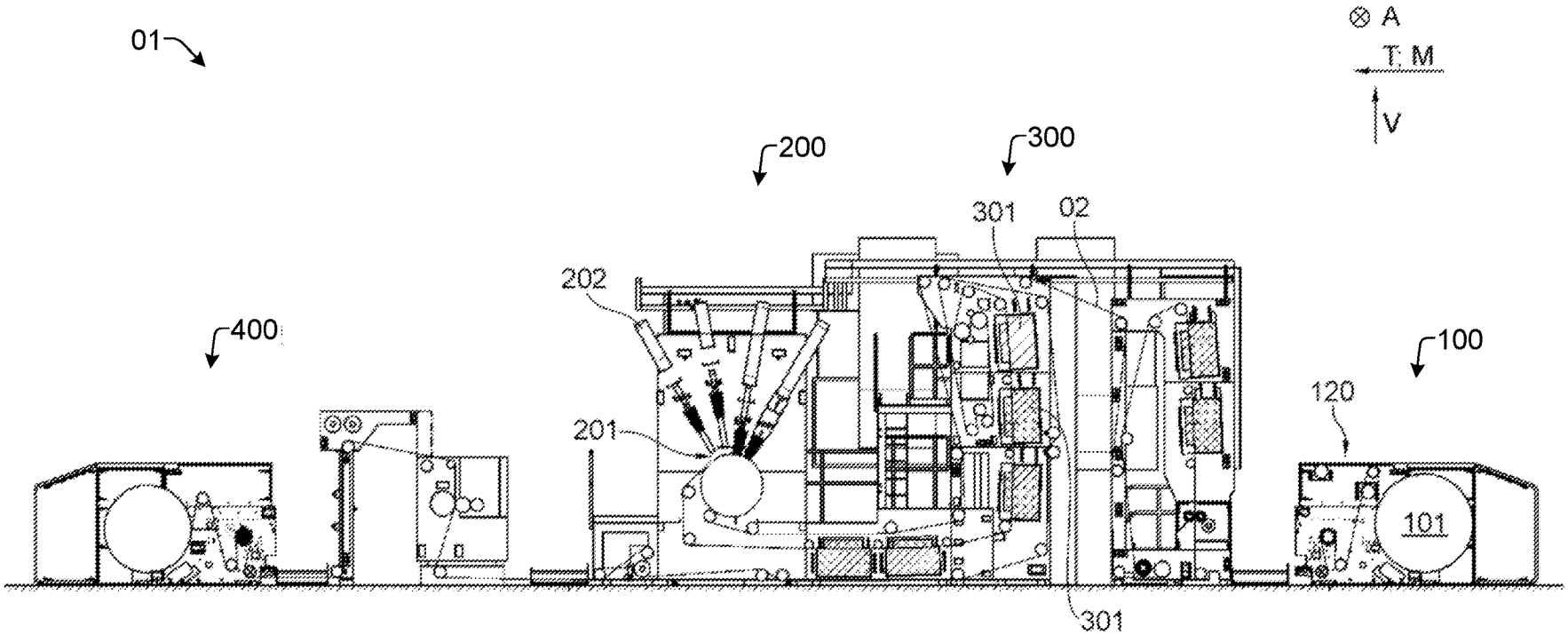
FIG. 2 a schematic illustration of a processing machine in another preferred embodiment as a web-fed ink jet printing press with a preferred position of a cleaning device.
Figure 3:
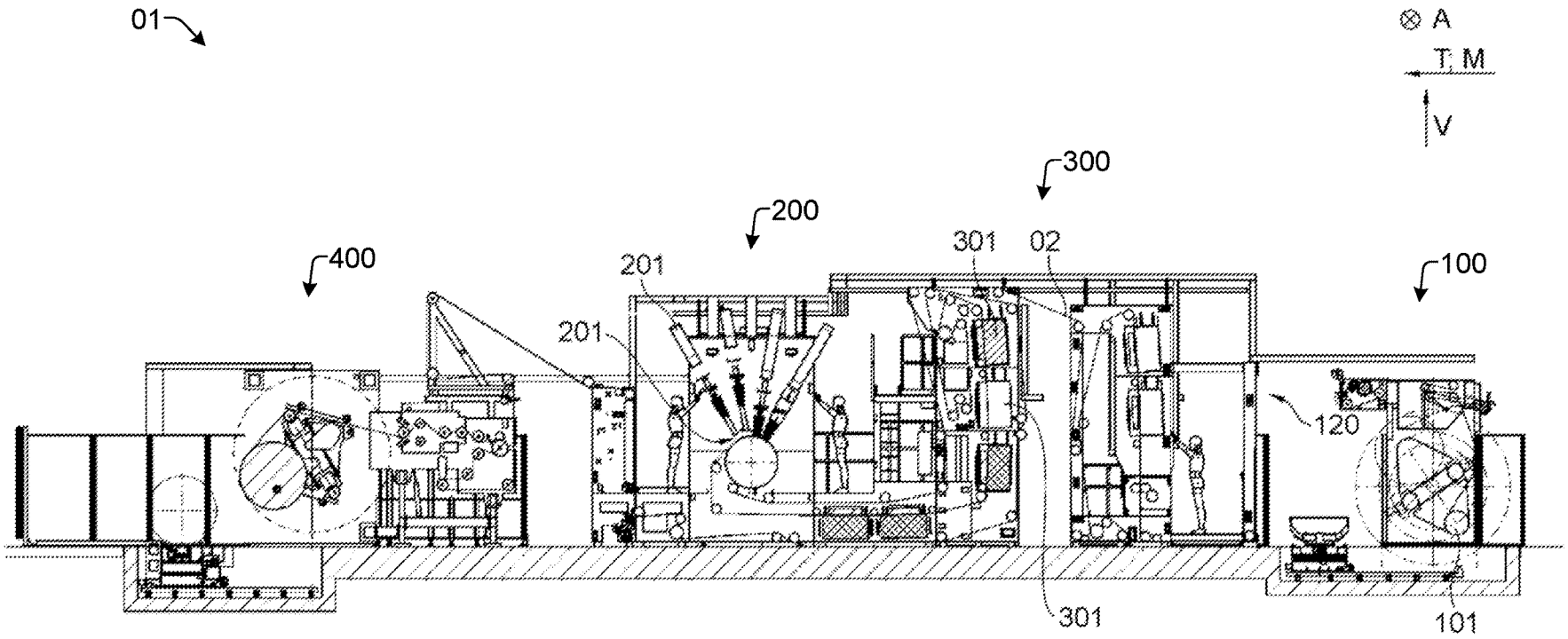
FIG. 3 a schematic illustration of a processing machine in yet another preferred embodiment as a web-fed ink jet printing press with another preferred position of a cleaning device.
Figure 4:
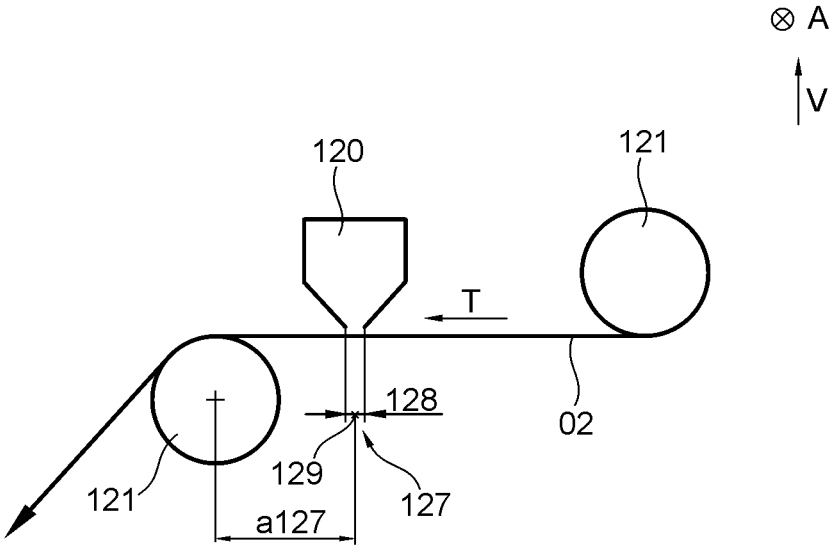
FIG. 4 a schematic illustration of the cleaning device in a first cleaning position.
Figure 5:
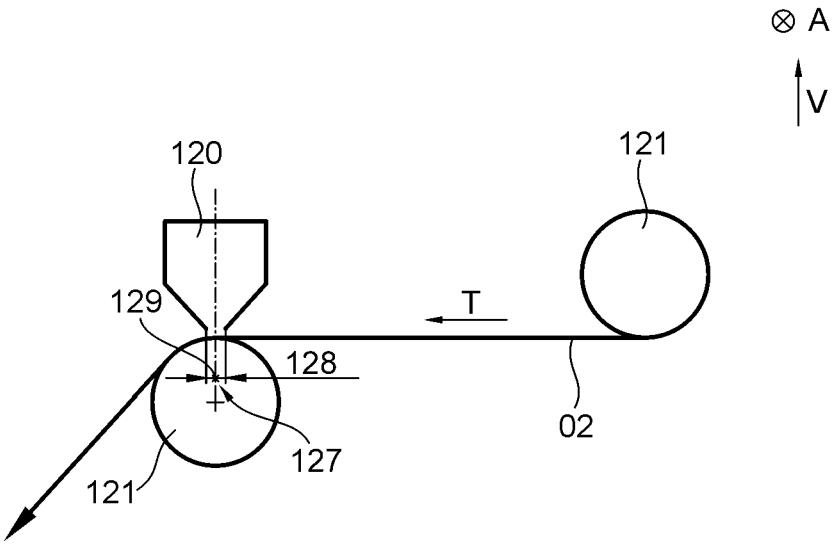
FIG. 5 a schematic illustration of the cleaning device in a second cleaning position.
Figure 6:
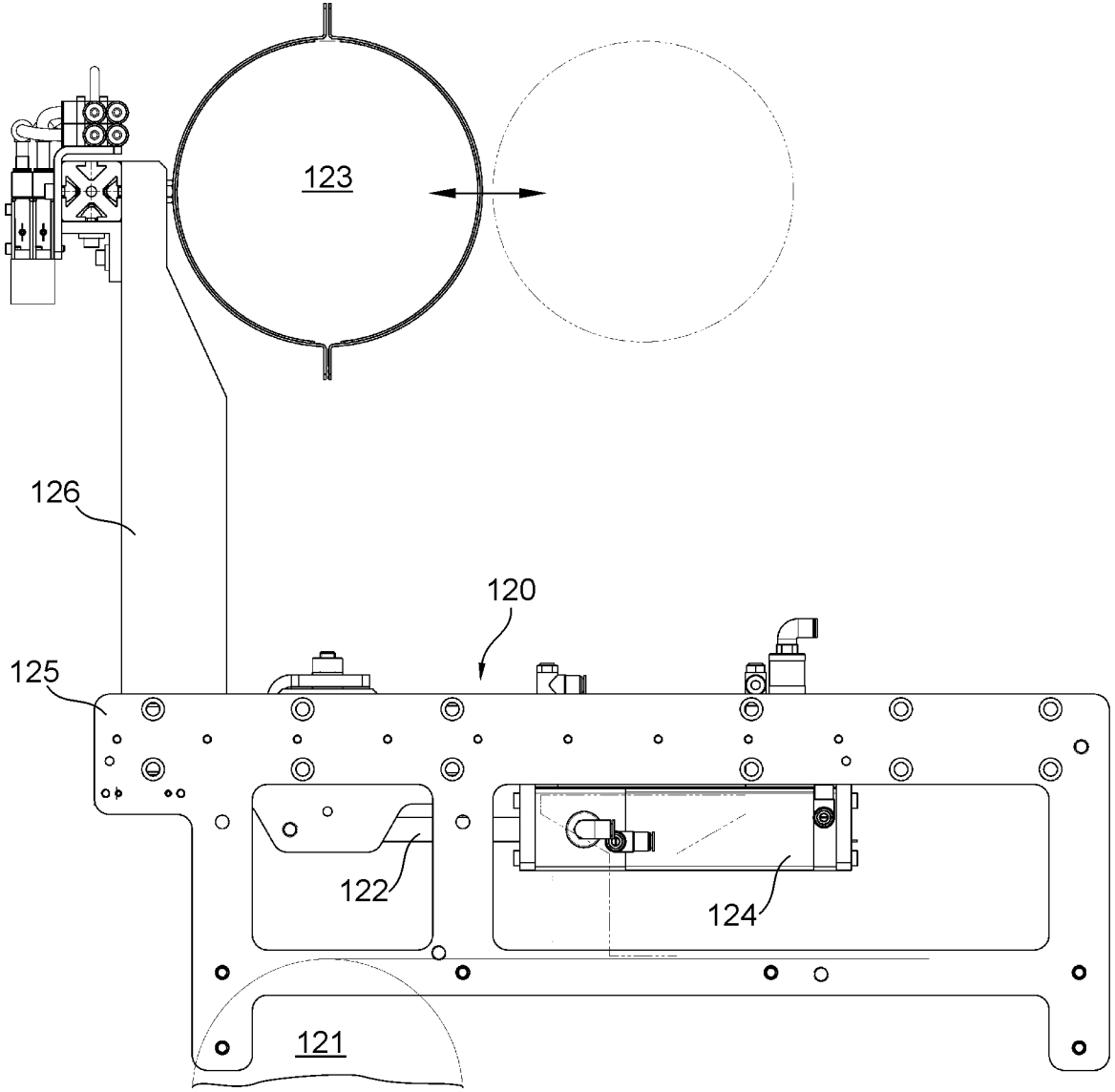
FIG. 6 a side view of a preferred embodiment of a displacement device for displacing the cleaning device.
Figure 7:
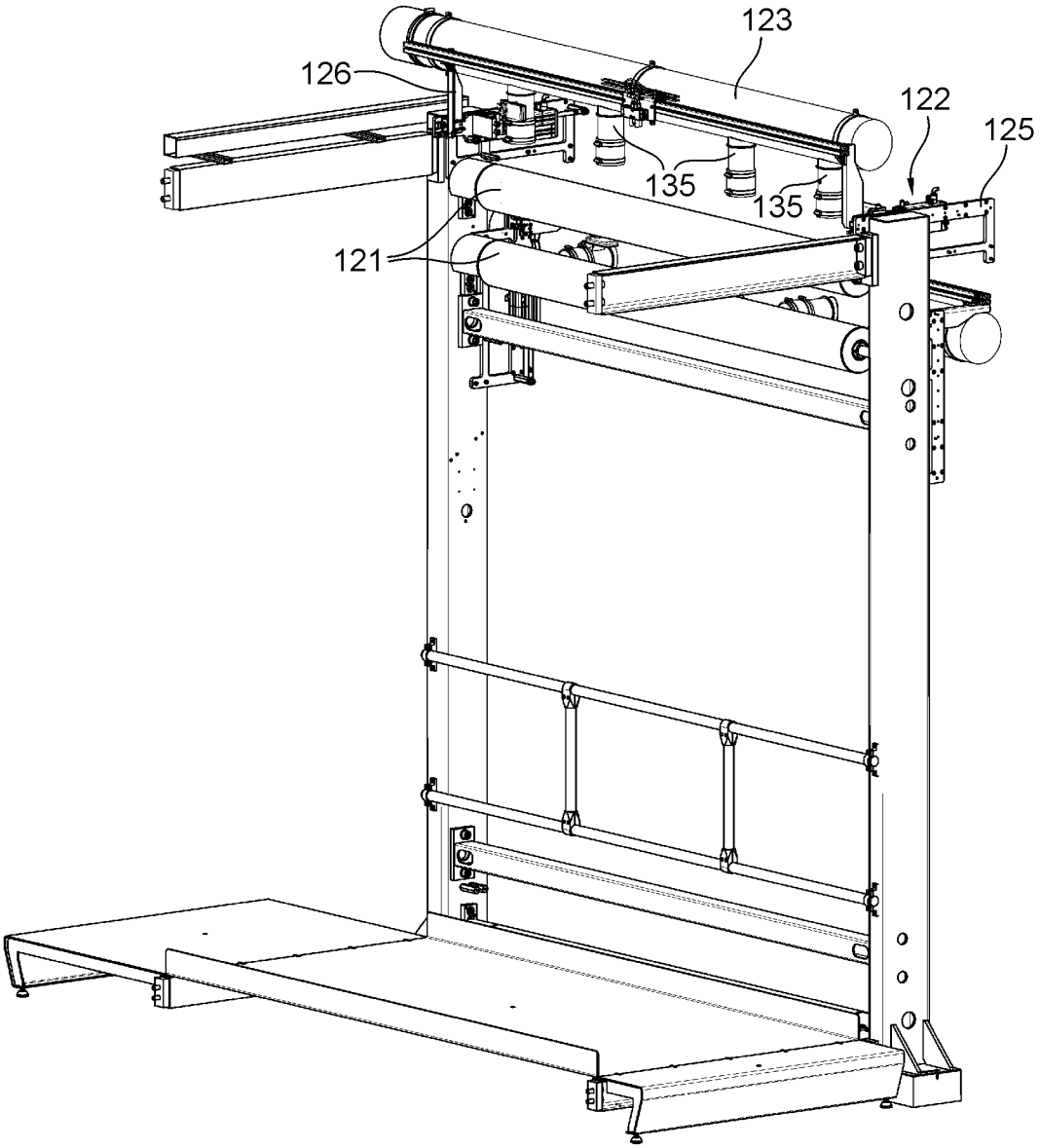
FIG. 7 a perspective view of a preferred embodiment of a displacement device for displacing the cleaning device from a first cleaning position into a second cleaning position.
Figure 8:
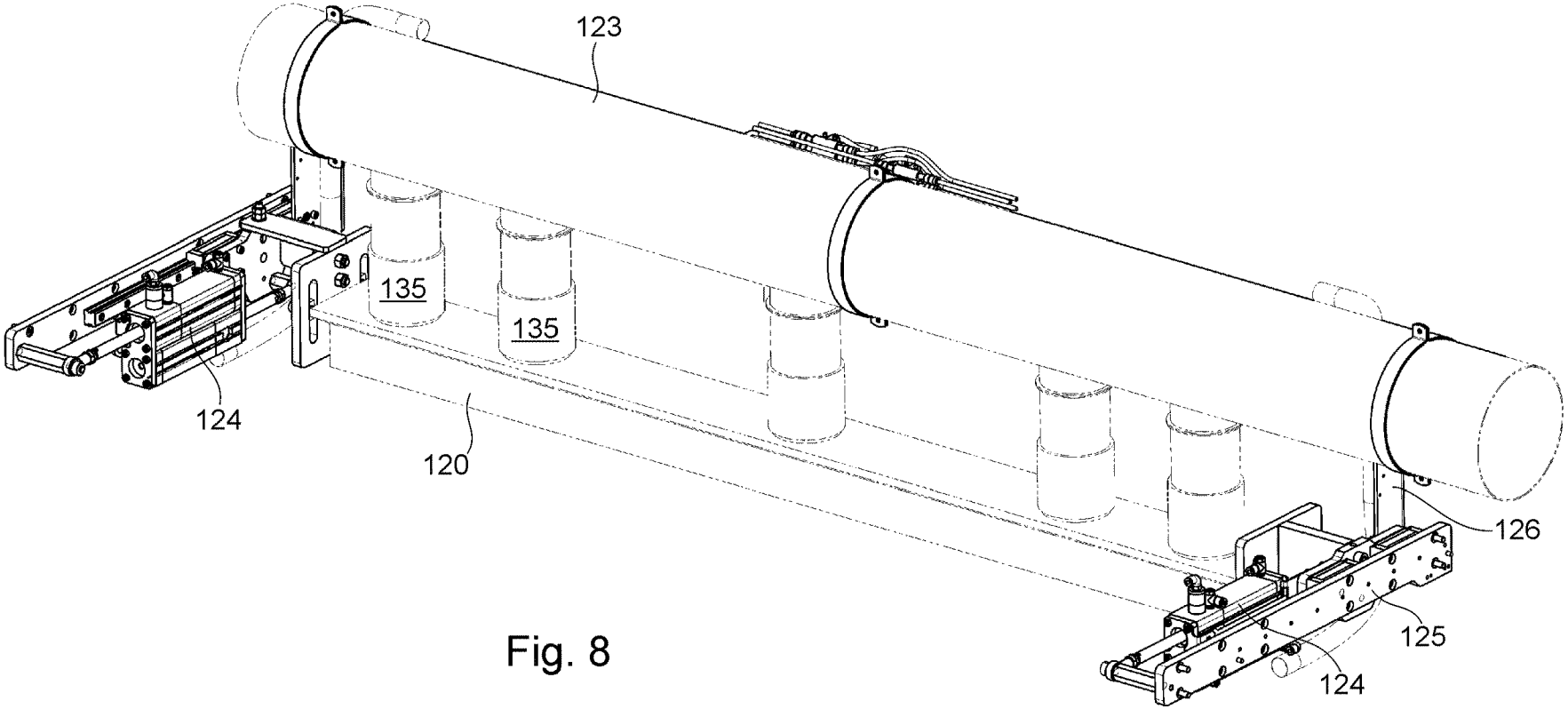
FIG. 8 a perspective view of a preferred embodiment of a displacement device.
Figure 9:
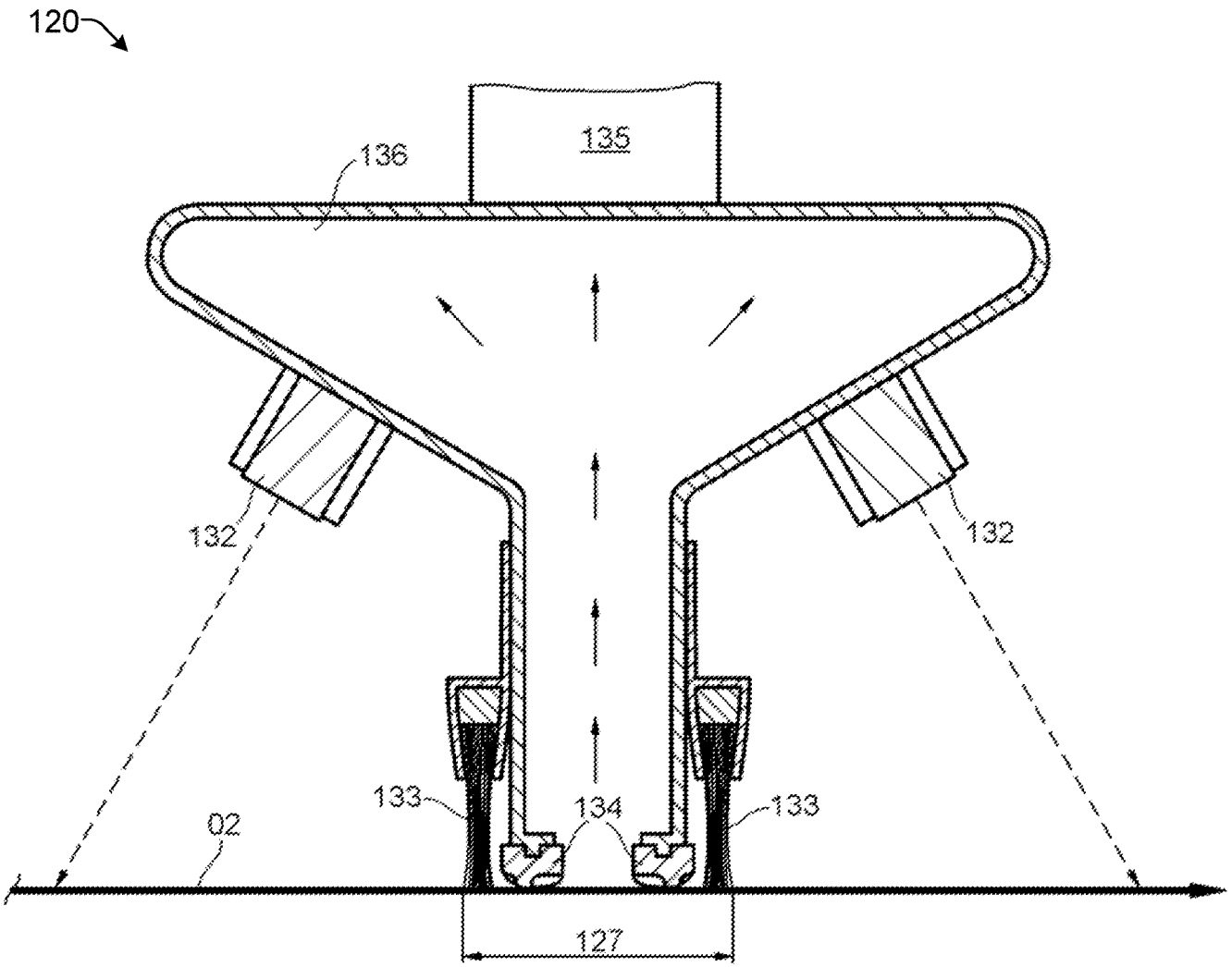
FIG. 9 a schematic illustration of the cleaning device in a side view.

The processing machine 01, in particular the web processing machine 01, is preferably configured as a printing press 01, in particular a web-fed printing press 01. Here, a printing press 01 shall be understood to mean a machine applying, or capable of applying, at least one printing fluid onto a substrate 02, in particular onto a printing substrate 02. A printing press 01 preferably comprises at least one subassembly 100 and/or one unit 100, for example a substrate source 100, in particular a printing substrate source 100. More preferably, the printing press 01 comprises at least one unit 200 configured as a first processing unit 200. More preferably, the processing unit 200 is configured as a subassembly 200 and, in particular, as a first printing assembly 200. The printing press 01 furthermore comprises at least one first means supporting the drying process, i.e., a first supporting means in a subassembly 300 and/or a unit 300, in particular a dryer unit 300, for example a first supplementary drying means 301, for example a first dryer 301. More preferably, the printing press 01 comprises at least one subassembly 400 and/or unit 400 configured as a post-processing apparatus 400. For example, the printing press 01, where necessary, comprises at least one second printing assembly and, for example, at least one second means supporting the drying process, i.e., supplementary drying means, for example a second dryer.

The printing press 01 is preferably configured as an ink jet printing press 01. The printing press 01 is preferably configured as a web-fed printing press 01, more preferably as a web-fed ink jet printing press 01. The printing press 01 can be configured as a printing press 01 operating according to the ink jet printing method, either overall or, possibly, in addition to other non-impact printing methods and/or printing forme-based methods, and in particular as an ink jet printing press 01 and/or as a web-fed ink jet printing press 01. The at least one first printing assembly 200 is preferably configured as at least one first ink jet printing assembly 200. In particular, the printing assembly 200 is preferably a printing assembly 200 for processing a substrate 02.

Above and below, substrate 02 refers to a sheet-format substrate 02 and/or a web-format substrate 02, in particular a substrate web 02. In general, substrate 02 encompasses both embodiments, as long as this does not result in any contradictions. In particular, embodiments including both processing machine types are described. In one embodiment of the processing machine 01 as a printing press 01, the substrate 02 is in particular configured as a printing substrate 02. Depending on the embodiment of the printing press 01, the printing substrate 02 is configured as a printing substrate web 02 or sheet 02. The substrate web 02 and/or the printing substrate web 02 can, for example, be a paper web. The sheet-format substrate 02, and in particular the sheet 02, is configured as corrugated cardboard and/or a corrugated cardboard sheet, for example. In a preferred embodiment, the substrate 02 is embodied as a substrate web 02, and the processing machine 01 is configured as a web processing machine 01.

In the case of a web-fed printing press 01, the printing substrate source 100 is configured as a roll unwinding device 100. Preferably, at least the substrate 02 is aligned in the printing substrate source 100, preferably at least with respect to an edge of this substrate 02. In the roll unwinding device 100 of a web-fed printing press 01, at least one web-format printing substrate 02, that is, a printing substrate web 02, preferably a paper web 02 is unwound from a substrate reel 101, in particular a printing substrate reel 101, and preferably aligned with respect to its edges in an axial direction A. The axial direction A is preferably a direction A that extends parallel to an axis of rotation of a horizontally extending direction A, in particular a transverse direction A. The transverse direction A is oriented orthogonally to a transport direction T intended for a transport of in particular web-format printing substrate 02 and/or orthogonally to an intended transport path of the substrate 02 through the at least one first printing assembly 200. In the case of a curved transport path, the transport direction T is preferably in each case the direction that runs tangential to a respective reference point of the next segment and/or point of the intended transport path. This respective reference point is preferably situated at the point and/or at the component that is being related to the transport direction T. Subsequent to the at least one printing substrate source 100, the transport path intended for a transport of the at least one printing substrate 02, and in particular the printing substrate web 02, preferably runs over multiple deflection means through the at least one first printing assembly 200, where a print image is applied to one side of the printing substrate 02, and in particular the printing substrate web 02, by means of at least one printing ink.

The substrate 02 is preferably a web-format planar material, such as paper and/or cardboard and/or paperboard and/or a thin, flexible or inflexible film. Furthermore, it is possible to print packaging materials having a rough surface, and woven fabrics. In particular, the web width is smaller than the working width of the processing machine 01.

According to DIN 6730 (February 2011), paper is a flat material, consisting mainly of fibers derived from vegetable sources, which is formed by the dewatering of a fiber suspension on a sieve. In the process, a card web is created, which is subsequently dried. The basis weight of paper is preferably a maximum of 225 g/m$^2$ (two hundred twenty-five grams per square meter).

According to DIN 6730 (February 2011), cardboard is a flat material, consisting mainly of fibers derived from vegetable sources, which is formed by the dewatering of a fiber suspension on a sieve or between two sieves. The fiber structure is compressed and dried. Cardboard is preferably manufactured from cellulose by gluing or pressing the cellulose together. Cardboard is preferably configured as solid board or corrugated cardboard. The basis weight of cardboard is preferably more than 225 g/m$^2$ (two hundred twenty-five grams per square meter). Corrugated cardboard is cardboard made of one or more layers of corrugated paper that is glued to one layer or between multiple layers of another, preferably smooth, paper or cardboard.

Above and below, the term paperboard refers to a sheet material that is preferably primed on one side and made of paper, having a basis weight of at least 150 g/m$^2$ (one hundred fifty grams per square meter) and no more than 600 g/m$^2$ (six hundred grams per square meter). Paperboard preferably has high strength relative to paper.

Unless an explicit distinction is made, the term sheet-format substrate 02, in particular printing substrate 02, specifically sheet 02, shall generally include any flat substrate 02 present in the form of sections, i.e., including substrates 02 in tabular form or panel form, i.e., including boards or panels. The sheet-format substrate 02 or sheet 02 thus defined is made, for example, of paper or paperboard, i.e., as a sheet of paper or paperboard, or by sheets 02, boards, or optionally panels made of plastic, cardboard, glass, or metal. More preferably, the substrate 02 is corrugated cardboard 02, in particular corrugated cardboard sheets 02. A thickness of a sheet-format substrate 02 or of a sheet 02 shall preferably be understood to mean a dimension orthogonal to a largest surface area of the sheet 02. This largest surface area is also referred to as the main surface area. The thickness of the sheet-format substrate 02 or of the sheet 02 is, for example, at least 0.1 mm (zero point one millimeters), more preferably at least 0.3 mm (zero point three millimeters), and still more preferably at least 0.5 mm (zero point five millimeters). Considerably greater thicknesses are also customary, especially in the case of corrugated cardboard sheets 02, for example at least 4 mm (four millimeters) or also 10 mm (ten millimeters) and more. Corrugated cardboard sheets 02 are relatively stable and are therefore not very flexible. Corresponding adaptations of the processing machine 01 therefore facilitate the processing of sheet-format substrate 02 or of sheets 02 of great thickness.

Preferably, at least one first dryer 301 is arranged along the transport path intended for the substrate 02, downstream from the at least one first printing assembly 200. The one first dryer 301 comprises a region for the substrate 02 that is configured as a drying section and defined by the exposure zone of the at least one dryer 301. After passing the at least one first printing assembly 200, the transport path of the printing substrate 02, and in particular of the printing substrate web 02, preferably passes through the at least one first dryer 301 so as to dry the applied printing fluid. The at least one first dryer 301 is preferably an integral part of the at least one dryer unit 300. The at least one first dryer 301 is preferably configured as an infrared radiation dryer. In a preferred embodiment, the at least one dryer unit 300 is also spatially arranged downstream from the printing assembly 200 in a machine direction M that is arranged so as to point from the first subassembly 100 to a last subassembly 400. In another embodiment, the at least one dryer unit 300 is arranged upstream from the at least one printing assembly 200 in the machine direction M. In particular, the transport direction T is then at least partially, and in sections, arranged counter to the machine direction T. In particular, the substrate 02 is then partially, and in sections, arranged to return in the processing machine 01.

Above and below, a vertical direction V refers to a direction that is preferably orthogonal on the plane spanned by the transverse direction A and the transport direction T. The vertical direction V, together with the transverse direction A and the transport direction T, preferably forms a Cartesian coordinate system. In particular, the vertical direction V preferably points away from the floor on which the processing machine 01 is located in the case of a transport direction T that runs parallel to the floor. In the case of a transport direction T that runs perpendicularly to the floor, the vertical direction V is preferably situated parallel to the floor on which the web processing machine 01 is located.

The printing press 01 is preferably characterized in that at least one, and preferably exactly one, preferably endless web-up means, which can be moved along at least one webbing-up path, for webbing up a substrate 02 is at least temporarily, and preferably permanently, arranged and/or can be arranged at least within the at least one dryer unit 300, and more preferably also within the at least one processing unit 200, and still more preferably in further regions of the printing press 01. The at least one webbing-up path and/or the at least one web-up means are preferably arranged outside the working width of the printing press 01, with respect to the transverse direction A. At least one substrate 02 is preferably connected and/or connectable via at least one connecting element, which is more preferably configured as at least one web-up kite, to the at least one web-up means, in particular independently of the configuration of the at least one web-up means as a web-up belt and/or web-up chain and/or endless web-up means and/or finite web-up means.

In the roll unwinding device 100, at least one printing substrate reel 101 is rotatably arranged. In a preferred embodiment, the roll unwinding device 100 is configured to be suitable for receiving a printing substrate reel 101, and thus has only one storage position for a printing substrate reel 101. In another embodiment, the roll unwinding device 100 is configured as a reel changer 100 and comprises storage positions for at least two printing substrate reels 101. The reel changer 100 is preferably configured so as to enable a flying change of reels, i.e., connecting a first substrate web 02 of a currently processed printing substrate reel 101 to a second substrate web 02 of a printing substrate reel 101 to be subsequently processed, while both the currently processed printing substrate reel 101 and the printing substrate reel 101 to be subsequently processed are rotating.

Along the intended transport path of the substrate 02, downstream from a reel holding device, the roll unwinding device 100 preferably comprises a dancer roller, which is preferably arranged deflectably at a dancer lever, and/or a first web edge aligner and/or an infeed unit including an infeed nip, formed by a draw roller and a draw impression roller, and comprising a first measuring device configured as a measuring roller, in particular an infeed measuring roller. This draw roller preferably comprises a dedicated drive motor, configured as a drawing drive motor, which is preferably connected to a machine control system. A web tension can be set and kept constant within boundaries, and/or the web tension is preferably kept constant within boundaries, by means of the dancer roller. The roll unwinding device 100 possibly comprises a pasting and cutting device, by means of which a flying reel change can be carried out, i.e., without idle time of the substrate web 02. The infeed unit is preferably arranged downstream from the first web edge aligner. The at least one draw roller is preferably arranged as an integral part of the infeed unit, and the draw impression roller is preferably configured to form the infeed nip together with the draw roller. The infeed nip is used to regulate a web tension and/or a transport of the substrate 02.

The invention will be described hereafter based on an ink jet printing press 01. However, the invention can also be used for other processing steps and non-impact printing methods, or completely different printing methods, such as rotary printing, offset printing, planographic printing, letterpress printing, screen printing or rotogravure printing, provided this does not result in any contradictions. The invention will be described hereafter in connection with a web-format substrate 02, i.e., a substrate web 02, in particular a web-format printing substrate 02, i.e., a printing substrate web 02. Corresponding features, however, can preferably likewise be applied to printing presses 01 for sheet-format substrate 02, in particular sheet-format printing substrate 02, provided this does not result in any contradictions.

The web processing machine 01 in particular comprises a processing unit 200, in particular a printing assembly 200. A printing assembly 200 shall be understood to mean a device by means of which at least one printing fluid is or can be applied to at least one of the sides of the one web-format or sheet-format printing substrate 02.

The at least one first printing assembly 200 of the printing press 01 preferably has at least one print position 201. A print position 201 shall preferably be understood to mean a region in which contact is established, or can be established, between a respective printing fluid and a printing substrate 02. The term 'print position' 201 shall also be used when the printing fluid is applied to the printing substrate 02 without pressing between the printing substrate 02 on the one hand, and a component transferring the printing fluid on the other hand, for example by freely movable printing fluid impinging on the printing substrate 02, for example flying drops of the printing fluid. A print position 201 preferably encompasses all regions that are intended for a certain printing fluid, which is in particular assigned to this print position 201, to impinge on the printing substrate 02. In the case of a printing assembly 200 operating according to the ink jet printing method, for example, a print position 201 encompasses all regions that are intended for black and/or colored ink to impinge on a first side of the printing substrate 02.

The at least one first printing assembly 200 preferably has multiple print positions 201, which are each assigned a respective printing fluid, for example at least four print positions 201, preferably at least five print positions 201, more preferably at least six print positions 201, and still more preferably at least seven print positions 201.

A working width of the printing press 01 and/or of the at least one printing assembly 200 is a dimension that preferably extends orthogonally to the intended transport path of the printing substrate 02 through the at least one first printing assembly 200, more preferably in the transverse direction A. The transverse direction A is preferably a horizontally extending direction. The transverse direction A is oriented orthogonally to the intended transport direction T of the printing substrate 02 and/or orthogonally to the intended transport path of the printing substrate 02 through the at least one printing assembly 200. The working width of the printing press 01 preferably corresponds to a maximum width that a printing substrate 02 is permitted to have for the printing press 01 to still be able to process it, i.e., a maximum printing substrate width that can be processed by the printing press 01. The working width of the printing press 01 preferably corresponds to the working width of the at least one first printing assembly 200. The working width of the printing assembly 200 in particular preferably corresponds to the maximum width that a printing substrate 02 is permitted to have for the printing assembly 200 to still be able to process it, i.e., a maximum printing substrate width that can be processed by the printing assembly 200. The working width of the web processing machine 01, in particular of the printing press 01 and/or of the at least one first printing assembly 200, and/or a width of a printing substrate 02 to be processed is, for example, at least 1,500 mm (one thousand five hundred millimeters), preferably at least 2,000 mm (two thousand millimeters), and more preferably at least 2,500 mm (two thousand five hundred millimeters). In particular, even larger working widths are possible.

For example, the at least one printing assembly 200 comprises at least two print heads 202, which are consecutively arranged with respect to the transport direction T established by the transport path intended for the transport of, in particular, web-format printing substrate 02, and which are preferably configured as ink jet print heads 202. The at least one printing assembly 200 preferably comprises at least four, more preferably at least eight, still more preferably at least ten, still more preferably at least twelve, and still more preferably at least fourteen such print heads 202 consecutively arranged with respect to the transport direction T established by the transport path intended for the transport of printing substrate 02.

The processing machine 01 more preferably comprises multiple guide elements 121 for guiding the substrate 02 through the processing machine 01. The multiple guide elements 121 are, for example, arranged so as to reroute the transport path and/or the transport direction T. For example, the multiple guide elements 121 are configured as rollers 121 and/or as guide rollers 121 for this purpose. The substrate 02 and preferably the substrate web 02 preferably at least partially wrap around the guide elements 121. The at least one guide element 121 is arranged to apply a force onto the substrate 02 for deflecting and/or rerouting the substrate 02. This force is preferably provided to act in the radial direction of the at least one guide element 121. The at least one force of the guide element 121 is a force and/or force component opposing the suction force of the cleaning device 120 and is provided to act in the direction of the guide element 121. In particular, a raising of the substrate 02 in the region of the guide elements 121 is made more difficult.

In another embodiment, support elements and/or transport elements can be arranged to prevent and/or vary the raising of the substrate 02 in sections of the processing machine 01. For example, such support elements and/or transport elements can be configured as vacuum chambers.

The at least one processing machine 01 furthermore comprises at least one cleaning device 120. Preferably, each side of the transport path and/or of the substrate 02 has at least one respective cleaning device 120. The at least one processing machine 01 preferably comprises at least one respective cleaning device 120 on the one side of the substrate 02, and at least one respective further cleaning device 120 on the opposite side of the substrate 02. In particular, the at least one cleaning device 120 is arranged in one of the subassemblies 100; 200; 300; 400 and/or units 100; 200; 300; 400. The at least one cleaning device 120 is preferably arranged in a processing machine 01 configured as a printing press 01, in particular an ink jet printing press 01, between a substrate source 100 and/or a reel changer 100 and a processing assembly 200 and/or a printing assembly 200. The at least one cleaning device 120 is preferably arranged at a displacement device for displacing the at least one cleaning device 120.

The at least one cleaning device 120 is preferably configured as a vacuum chamber 136 and/or vacuum cleaning device. The at least one cleaning device 120 is preferably arranged so as to apply a suction force, at least onto a cleaning region 127. In particular, the at least one cleaning device 120 is arranged so as to apply a cleaning action across the entire working and/or web width. In particular, the at least one cleaning device 120 is suitable for carrying out contactless cleaning. The cleaning device 120 is, in particular, arranged so as to apply a suction power and/or suction force onto the cleaning region 127, so that contactless cleaning is possible. A distance during the contactless cleaning is, for example, between 1 mm (one millimeter) and 3 cm (three centimeters). In a preferred arrangement, a distance during the contactless cleaning is 2 mm (two millimeters). More preferably, the at least one cleaning device 120 comprises multiple elements that enhance turbulence of the air taken in. In particular, particles, in particular dust particles, on the substrate surface are loosened and/or detached as a result of the turbulence of the air taken in, preferably before the air is suctioned into the cleaning device 120.

Moreover, the at least one cleaning device 120 comprises one and/or multiple brushes for cleaning the substrate 02 with contact. The brushes of the at least one cleaning device 120 are preferably arranged so as to be displaceable. In a preferred embodiment, the at least one cleaning device 120 comprises an electrical charger 132 and/or a device for ionizing 132 particles, in particular dust particles. In particular, the ionization device 132 comprises at least one first ionization site and a second ionization site. The at least one cleaning device 120 ionizes and/or deionizes the substrate 02, before passing through and/or after passing through the at least one cleaning device 120, by means of an ionization device 132. A substrate 02 is preferably ionized before passing through the at least one cleaning device 120, and is preferably deionized after passing through the cleaning device 120. In this way, particles on the substrate 02 are preferably loosened and can be removed more easily by the at least one cleaning device 120. Deionization prevents charges from being present after the passing through the cleaning device, so that other equipment parts are not impaired by the charges. Furthermore, the at least one cleaning device 120 comprises a unit for adapting the suction power to the width of the substrate 02. The suction air of the at least one cleaning device 120 is preferably discharged by means of a collector pipe 123, in particular in the case of large web widths of more than 1 m (one meter), more preferably more than 1.5 m (one point five meters). For this purpose, the at least one cleaning device 120 comprises at least one, preferably one respective, valve at extraction connectors 135, preferably at least at the outer extraction connectors 135. The extraction connectors 135, preferably the at least three, more preferably the at least five extraction connectors 135 are functionally connected to the at least one collector pipe 123. Such a valve can be closed if needed, and suction power in the outer region of the web can thus be blocked. For example, the at least one cleaning device 120 can thus be easily adapted to various web widths. The suction power of the at least one cleaning device 120 can be adapted to a width of a substrate 02 by switching on and/or off extraction connectors 135 by means of multiple valves. The at least one cleaning device 120 is preferably configured to be noise-reduced. The extracted dust and/or the particles are collected and/or stored in a dust collection container that is functionally connected to the collector pipe 123. Preferably, each cleaning device 120 is functionally connected to at least one dust collection container.

The at least one cleaning device 120 is preferably arranged as perpendicular to the transport direction T above the substrate 02 and/or beneath the substrate 02 and/or the transport path provided above the substrate 02 and/or beneath the substrate 02. Moreover, the at least one cleaning device 120 is arranged so as to be displaceable into preferably at least two positions at least parallel to the substrate 02 and/or the intended transport path of the substrate 02.

The at least one cleaning device 120 is assigned a cleaning region 127 on the substrate 02 and/or the transport path intended for the substrate 02. In particular, the cleaning region 127 is the region to which the at least one cleaning device 120 is functionally connected during operation. In particular, the cleaning region 127 is the region in which still at least 50% (fifty percent) of the suction power of the cleaning device 120 is received and/or effective.

In the embodiment of the at least one cleaning device 120 comprising multiple contact cleaning elements 133, preferably brushes 133, the brushes 133 are arranged so as to surround the cleaning region 127. In particular, the air extraction system is arranged between the brushes 133. In particular, the cleaning region 127 is then defined by the projection of the brushes 133 onto the substrate 02 and/or onto the transport path intended for the substrate 02.

The at least one cleaning region 127 is preferably configured as a surface area on the substrate 02 and/or on the intended transport path of the substrate 02. When the cleaning region 127 is projected into the plane that is spanned by the vertical direction V and the machine direction M, the cleaning region 127 is configured as a stretch 128 of the projection, and the stretch 128 has a center 129.

The at least one cleaning device 120 is preferably arranged so as to be displaceable from a first cleaning position into a second cleaning position. In particular, in the first cleaning position, the at least one cleaning device 120 has a cleaning region 127 on the substrate 02 of the substrate web 02 and/or on the intended transport path of the substrate 02 and/or is functionally connected. In the second cleaning position of the at least one cleaning device 120, the at least one cleaning region 127 is arranged so as to be in particular shifted parallel to the substrate 02. The at least one cleaning device 120 is preferably arranged so as to be displaceable by a drive 124. The at least one drive 124 is, for example, arranged as an electric motor, as a hand wheel and/or more preferably as a hydraulically and/or pneumatically displaceable drive 124. In a preferred embodiment, the at least one drive 124 is configured as a hydraulic cylinder 124. The at least one cleaning device 120 is in particular arranged so as to be displaceable on a linear guide 122. The linear guide 122 is preferably arranged so as to be displaceable at least parallel to the transport direction T and/or the transport path. The at least one cleaning device 120 is arranged so as to be attached to the machine housing via a frame 125.

In another embodiment, for example in the case of a substrate 02 embodied as a sheet 02, the at least one cleaning device 120 is also arranged so as to be displaceable perpendicularly to the transport direction T. In particular, a distance with respect to the transport path and/or with respect to the substrate 02 can thus be set.

The at least one cleaning device 120 and/or the substrate 02 are arranged in multiple states with respect to one another. States, here, preferably refer to positions of the cleaning device 120 and of the substrate 02. The at least one cleaning device 120 and/or the substrate 02 can preferably be arranged at least in a first cleaning state and a second cleaning state, wherein the at least one cleaning device 120 and the substrate 02 are each arranged in a working position in the first cleaning state and the second cleaning state. In both cleaning states, the at least one cleaning device 120 is arranged so as to clean the substrate 02. In the first cleaning state, the at least one cleaning device 120 is arranged so as to clean the substrate 02 in a contactless manner. In the second cleaning state, the at least one cleaning device 120 is arranged so as to clean the substrate 02 based on contact and/or touch.

In the first cleaning state, the at least one cleaning device 120 is arranged in the first cleaning position. In the first cleaning state, the substrate 02 is arranged spaced apart from the at least one cleaning device 120. The at least one cleaning device 120 is preferably functionally connected to a cleaning region 127 on the substrate 02.

In the second cleaning state, the at least one cleaning device 120 is arranged in the second cleaning position. In the first cleaning state, the substrate 02 is arranged so as to be in contact with and/or in touch with the at least one cleaning device 120. The at least one cleaning device 120 is preferably functionally connected to a cleaning region 127 on the substrate 02.

For the transfer from the first cleaning state into the second cleaning state, the at least cleaning device 120 is, preferably only, displaceably arranged. In particular, the at least one cleaning device 120 is preferably only arranged in a manner that is displaced parallel to the substrate 02 and/or to the transport path intended for the substrate 02 and/or to the transport direction T. In particular, a cleaning region 127 of the at least one cleaning device 120 is preferably arranged so as to be shifted on the transport path of the substrate 02. In the first cleaning position, the at least one cleaning device 120 is arranged so as to apply a suction force onto the cleaning region 127 of the first cleaning position, and in the second cleaning position, the at least one cleaning device 120 is arranged so as to apply a suction force onto the cleaning region 127 that is shifted on the transport path.

The substrate 02 has a higher force and/or force component opposing the suction force in the cleaning region 127 of the first cleaning position of the cleaning device 120 than in the cleaning region 127 of the second cleaning position of the cleaning device 120. In particular, the force and/or force component opposing the suction force is, in particular, so great that the substrate 02 and/or the substrate web 02 is arranged at a distance with respect to the at least one cleaning device 120.

In a preferred embodiment, the at least one cleaning region 127 of the first cleaning position of the cleaning device 120 is arranged so as to be functionally connected to at least one guide element 121 and/or a support element and/or a transport element. Functionally connected denotes, in particular, a diversion and/or a force component and/or force opposing the suction force of the at least one cleaning device 120. In the first cleaning position of the cleaning device 120, the substrate 02 is preferably arranged on the region located opposite the cleaning region 127, on the opposite side of the substrate 02 and/or the opposite side of the transport path intended for the substrate 02, in contact with a guide element 121.

In the first cleaning position of the cleaning device 120, perpendicular to the transport direction T, the cleaning region 127 is arranged above the at least one guide element 121 and/or has a first distance, parallel to the transport direction T, with respect to the at least one guide element 121. Further preferably, 'above the guide element 121' denotes that the connecting line of the center 129 between the stretch 128 of the projection of the cleaning region 127 and the centroid and/or the axis of rotation of the at least one guide element 121 is perpendicular to the transport direction T at the center 129.

The substrate 02 has a lower force and/or force component opposing the suction force in the cleaning region 127 of the second cleaning position of the second cleaning device 120 than in the cleaning region 127 of the second cleaning position of the cleaning device 120. In particular, the force and/or force component opposing the suction force is, in particular, so small that the substrate 02 is arranged in contact with the at least one cleaning device 120 and/or in contact with the brushes 133 of the at least one cleaning device 120.

In the second cleaning position of the at least one cleaning device 120, the at least one cleaning region 127 is arranged so as to be spaced apart from the at least one guide element 121. In the second cleaning position, the cleaning region 127 is arranged so as to be spaced apart from the at least one guide element 121, parallel to the transport direction T, at a distance a127, and the distance a127 is arranged to be greater than the distance of the cleaning region 127 in the first cleaning position of the at least one cleaning device 120 arranged. In particular, the distance a127 of the cleaning region 127 with respect to a guide element 121 denotes the distance a127, parallel to the transport direction T, from the center 129 of the cleaning region 127 to the centroid and/or the axis of rotation of the at least one guide element 121. Further preferably, the connecting line between the center 129 of the stretch 128 of the projection of the cleaning region 127 and the centroid and/or the axis of rotation of the at least one guide element 121 is an angle of less than 90° (ninety degrees) with respect to the transport direction T at the center 129.

In the second position, the at least one cleaning device 120 is arranged spaced apart from the at least one guide element 121. In particular, a distance is so large, for example, that a paper web-up is possible.

In particular, the cleaning device 120, during a displacement from the first cleaning position into the second cleaning position, is arranged so as to be displaced parallel to the substrate 02 and/or the transport path intended for the substrate 02. Furthermore, the cleaning region 127 of the first cleaning position of the cleaning device 120 is in particular arranged so as to be shifted with respect to the cleaning region 127 of the second cleaning position, parallel to the transport path.

The at least one processing machine 01 preferably comprises at least one respective cleaning device 120 on the one side of the substrate 02, and at least one respective further cleaning device 120 on the opposite side of the substrate 02.

The cleaning of the substrate 02 is preferably set and/or adjusted as a function of the substrate properties and/or the substrate format and/or the machine speed. In particular, the at least one cleaning device 120 is operated at a distance with respect to the substrate 02 in the case of sensitive substrates 02, such as for example in the case of thin substrates 02.

In the first cleaning state, the substrate 02 runs past the at least one cleaning device 120, for example, at a distance of 2 mm (two millimeters).

In the case of thicker substrates 02 and/or heavy soiling, the at least one cleaning device 120 is operated so as to be in contact with the substrate 02.

The distance between at least one cleaning device 120 and a substrate 02 is adjusted as a function of the substrate properties and/or as a function of the substrate format and/or as a function of a mode of operation of the processing machine 01. In particular, a distance between a cleaning device 120 and a substrate 02 is set by varying the position of the substrate 02 and/or of the transport path intended for the substrate 02 by way of the suction force of the cleaning device 120. Preferably, a distance between the at least one cleaning device 120 and a substrate 02 is set by shifting the at least one cleaning device 120 into a region on the transport path of the substrate 02 with a different force component opposing the suction force. Preferably, the at least one cleaning device 120, for setting the distance between the cleaning device 120 and the substrate 02, a distance is varied between the cleaning device 120 and a guide element 121 arranged beneath the substrate 02 and/or beneath the transport path provided for the substrate 02. In addition, for example, the distance between the substrate 02 and/or the transport path intended for the substrate 02 and the at least one cleaning device 120 is arranged so as to be varied during the displacement from the first cleaning position into the second cleaning position. In addition to the parallel displacement with respect to the transport path, this is achieved, for example, through a perpendicular displacement of the at least one cleaning device 120. In particular, the at least one cleaning device 120, during a displacement from the first cleaning position into the second cleaning position, is arranged so as to be displaced perpendicularly to the substrate 02 and/or the transport path intended for the substrate 02.

The cleaning device 120 is displaced for the transfer from the first cleaning state into the second cleaning state. Preferably, only the at least one cleaning device 120 is displaced. In particular, the cleaning region 127 is thereby shifted on the substrate 02 and/or the transport path intended for the substrate.

The cleaning device 120 acts with a suction force on the substrate 02 in the cleaning states. In particular, the substrate 02 includes various regions on which different forces and/or directional vectors of the forces and/or force components act. In particular, guide elements 121 deflect the substrate 02 from the transport path. The substrate 02 preferably at least partially wraps around the at least one guide element 121. In particular, a force and/or force component is applied onto the substrate so as to deflect the transport path.

The substrate 02 in particular includes regions on which it is more difficult to lift off the substrate 02. During the transfer from the first cleaning state into the second cleaning state, the at least one cleaning device 120, and thus the cleaning region 127, is shifted. In particular, the cleaning device 120 is shifted into a region having a lower force opposing the suction force of the cleaning device 120. The substrate 02 is raised as a result of the vacuum pressure and/or the suction pressure applied to the respective cleaning region 127, so that the cleaning device 120 and the substrate 02 come in contact. In particular, the substrate 02 is thus guided by way of a contact surface of the cleaning device 120 and/or by way of a contact with the brushes 133 of the cleaning device 120. The contact surface preferably includes a pattern to intensify the turbulence of the air that is taken in and to improve the cleaning action. For this purpose, the at least one cleaning device 120 in particular comprises at least one, preferably two contact elements 134 with the contact surfaces. The contact elements 134 configured as flow elements 134 in particular have a structure that causes turbulence of the flow in the area of the cleaning region 127, and thereby results in improved cleaning. In a cleaning region 127 of the at least one cleaning device 120, turbulence of air is created by means of at least one flow element 134. For this purpose, the contact elements 134 include grooves, for example, which are preferably obliquely situated. As a result of turbulence of the suction air, the flow elements 134 in particular improve cleaning with contact and/or without contact. The at least one cleaning device 120 comprises at least one, more preferably at least two, or exactly two, flow elements 134.

In a preferred embodiment, a distance between the at least one cleaning device 120 and at least one guide element 121 is increased. In particular, the cleaning device 120 is, preferably only, displaced parallel to the substrate 02. For example, the cleaning device 120 is displaced by means of the drive 124. The drive 124 is preferably configured as a hydraulic cylinder 124 and predefines a, preferably purely linear, movement. The at least one cleaning device 120 is functionally connected to the drive 124 via a guide element 126. The air taken in is collected by way of a collector pipe 123, which is connected to the cleaning device 120, and is discharged.

Although the disclosure herein has been described in language specific to examples of structural features and/or methodological acts, it is to be understood that the subject matter defined in the appended claims is not necessarily limited to the specific features or acts described in the examples. Rather, the specific features and acts are disclosed merely as example forms of implementing the claims.

The invention claimed is:

1. A web processing machine comprising:

at least one cleaning device for cleaning a substrate transported along a transport path, the at least one cleaning device comprising at least two flow elements and/or brushes;

the at least one cleaning device and the substrate configured to be arranged in a first cleaning state and a second cleaning state, wherein, in the first cleaning state, the substrate is arranged spaced apart from the at least one cleaning device and, in the second cleaning state, the substrate is arranged so as to be in contact with the at least two flow elements and/or the brushes of the at least one cleaning device;

the at least one cleaning device and the substrate being arranged so as to be transferrable at least from the first cleaning state into the second cleaning state;

the at least one cleaning device being arranged so as to be displaced from a first cleaning position in the first cleaning state into a second cleaning position in the second cleaning state, wherein, in the first cleaning position, the at least one cleaning device is functionally connected to a cleaning region on the substrate and/or on the transport path intended for the substrate, and wherein, in the second cleaning position of the at least one cleaning device, the cleaning region is arranged so as to be shifted on the substrate and/or on the transport path intended for the substrate; and wherein, in the first cleaning state and in the second cleaning state, the at least one cleaning device is arranged so as to apply a suction force at least onto the cleaning region.

2. The web processing machine according to claim 1, wherein a guide element deflecting the transport path of the substrate is arranged so as to increase a force component opposing the suction force applied onto the substrate in the cleaning region of the first cleaning position compared to the cleaning region in the second cleaning position.

3. The web processing machine according to claim 1, wherein the cleaning device, during a displacement from the first cleaning position into the second cleaning position, is arranged so as to be displaced parallel to the substrate and/or the transport path intended for the substrate.

4. The web processing machine according to claim 1, wherein the at least one cleaning device, at least in the first cleaning position, is arranged on a side of the transport path and/or the substrate that is opposite to a side of the transport path and/or substrate on which a guide element is arranged.

5. The web processing machine according to claim 1, wherein the at least one cleaning device is arranged between a substrate source and a printing assembly.

6. The web processing machine according to claim 1, wherein the at least one cleaning device is configured as a cleaning device comprising a vacuum chamber and/or an ionization device.

7. The web processing machine according to claim 1, wherein a suction power of the at least one cleaning device is adaptable to a width of the substrate by switching on and/or off extraction connectors by means of multiple valves.

* * * * *